US010815924B2

(12) United States Patent
Honjo

(10) Patent No.: US 10,815,924 B2
(45) Date of Patent: Oct. 27, 2020

(54) WORK VEHICLE

(71) Applicant: Kubota Corporation, Osaka-shi (JP)

(72) Inventor: Noriyasu Honjo, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 16/001,983

(22) Filed: Jun. 7, 2018

(65) Prior Publication Data

US 2019/0145336 A1 May 16, 2019

(30) Foreign Application Priority Data

Nov. 14, 2017 (JP) ..... 2017-219039

(51) Int. Cl.

| | |
|---|---|
| ***F02D 41/22*** | (2006.01) |
| ***F02D 41/04*** | (2006.01) |
| ***F02D 33/00*** | (2006.01) |
| ***G07C 5/08*** | (2006.01) |
| ***F02D 29/02*** | (2006.01) |
| ***F02D 11/10*** | (2006.01) |

(52) U.S. Cl.

CPC ..... *F02D 41/22* (2013.01); *F02D 11/106* (2013.01); *F02D 29/02* (2013.01); *F02D 33/003* (2013.01); *F02D 33/006* (2013.01); *F02D 41/042* (2013.01); *G07C 5/0816* (2013.01); *F02D 2041/228* (2013.01); *F02D 2200/0406* (2013.01); *F02D 2200/101* (2013.01)

(58) Field of Classification Search

CPC ..... F02D 41/22; F02D 41/042; F02D 41/221; F02D 33/003; F02D 2041/228; F02D 2041/227; F02D 2200/0406; F02D 2200/101; F02D 41/222; G07C 5/0816; G01F 1/34; G01F 1/36; G01F 1/363; F02N 11/00

See application file for complete search history.

(56) References Cited

U.S. PATENT DOCUMENTS 4,890,590 A * 1/1990 Iwamoto ..... F02B 77/088 123/198 D
4,903,526 A * 2/1990 Miyama ..... F02D 41/22 73/114.36
5,614,666 A * 3/1997 Hara ..... F02D 31/005 123/339.15

(Continued)

FOREIGN PATENT DOCUMENTS

JP 2006194208 A 7/2006

*Primary Examiner* — George C Jin

(74) *Attorney, Agent, or Firm* — The Webb Law Firm

(57) ABSTRACT

There are provided an intake pressure detecting means for detecting an intake pressure on more downstream side than a throttle valve in an intake passage to an engine, a rotational speed detecting means for detecting a rotational speed of an engine, an engine controlling means for controlling the engine to arrive at a target air-fuel ratio corresponding to the detected intake pressure and the detected engine rotational speed and an abnormality treating means for executing an engine stopping treatment to stop the engine if an intake pressure higher than a set pressure has been detected and an engine rotational speed higher than a set rotational speed has been detected, when an opening degree state detecting means detects that the throttle valve is under a fully closed or substantially fully closed state.

4 Claims, 4 Drawing Sheets

(56) References Cited

U.S. PATENT DOCUMENTS

| | | | | |
|---|---|---|---|---|
| 2005/0256632 | A1* | 11/2005 | McGee | B60K 6/445 701/101 |
| 2008/0178838 | A1* | 7/2008 | Ota | F02D 31/005 123/339.1 |
| 2013/0167802 | A1* | 7/2013 | Uchiyama | F02D 31/005 123/339.23 |
| 2013/0231843 | A1* | 9/2013 | Nakagawa | F02D 41/221 701/102 |

* cited by examiner

WORK VEHICLE

CROSS-REFERENCE TO RELATED APPLICATION

This application claims priority to Japanese Patent Application No. 2017-219039 filed Nov. 14, 2017, the disclosure of which is hereby incorporated in its entirety by reference.

BACKGROUND OF THE INVENTION

1. Field of the Invention

The present invention relates to a work vehicle having an engine and a throttle valve incorporated in an intake passage to the engine, the throttle valve being operable in response to an operation on an accelerator operational tool.

2. Description of Related Art

As such work vehicle as above, there is known a work vehicle having a controlling means for controlling the engine, configured such that an intake pressure on more downstream side than the throttle valve in the intake passage is detected by an intake pressure sensor and based on such detected intake pressure and an engine rotational speed detected by an engine rotation sensor, a target air-fuel ratio, a target fuel injection timing, a target ignition timing, etc. may be achieved (for instance, see Patent Document 1). Though Patent Document 1 does not detail the contents of control, for instance, for an intake pressure and an engine rotational speed, a target air-fuel ratio is preset as "map data" and from actually detected intake pressure and engine rotational speed, a target air-fuel ratio corresponding to these actual intake pressure and engine rotational speed is obtained and a fuel injection amount is adjusted.

RELATED ART DOCUMENT

Patent Document

Patent Document 1: Japanese Unexamined Patent Application Publication No. 2006-194208

SUMMARY OF THE INVENTION

Problem to be Solved by Invention

With the above-described conventional arrangement, when a normal intake condition is maintained in the intake passage, adjustment to an appropriate fuel injection amount is possible. However, if certain abnormality develops in the intake passage, appropriate fuel injection amount adjustment may not be possible.

For instance, when abnormality occurs such as breakage of an intake pipe between the throttle valve and the engine, detachment of a bolt of a flange portion for coupling the pipe, the intake pressure may rise due to such cause. As a result, in spite of absence of an accelerator operation, rather high intake pressure will be detected and the fuel injection amount will be adjusted rather high in correspondence therewith, thus inviting excessive rise in the engine rotational speed. As rise of intake pressure and rise of engine rotational speed associated therewith can occur even when a normal operation is being effected, the controlling means will continuously effects its controlling state.

Then, it has been desired not to allow abnormality such as excessive rise in the engine rotational speed to continue in a prolonged period when the abnormality developed in the intake passage to the engine.

Solution

According to a characterizing feature of the present invention, a work vehicle comprises:

a throttle valve incorporated in an intake passage to an engine and operable in response to an operation on an accelerator operational tool;

an intake pressure detecting means for detecting an intake pressure on more downstream side than the throttle valve in the intake passage;

a rotational speed detecting means for detecting a rotational speed of the engine;

an engine controlling means for controlling the engine based on a detection value of the intake pressure detecting means and a detection value of the rotational speed detecting means to arrive at a target air-fuel ratio corresponding to the detected intake pressure and the detected engine rotational speed;

an opening degree state detecting means for detecting an opening degree state of the throttle valve; and an abnormality treating means for executing an engine stopping treatment to stop the engine if the intake pressure detecting means detects an intake pressure higher than a set pressure and the rotational speed detecting means detects an engine rotational speed higher than a set rotational speed, when the opening degree state detecting means detects that the throttle valve is under a fully closed or substantially fully closed state.

With the invention described above, the engine controlling means obtains a target air-fuel ratio corresponding to an intake pressure detected by the intake pressure detecting means and an engine rotational speed detected by the rotational speed detecting means and controls the engine in such a manner as to arrive at such target air-fuel ratio. Specifically, the fuel supply amount to the engine is variably adjusted. In this, under a normal operational state, the throttle valve will be adjusted based on an accelerator operation, so that an intake pressure corresponding to this adjustment will be detected.

However, when certain abnormality develops in the intake passage, even if no acceleration operation is effected and the throttle valve remains closed, a rather high intake pressure higher than the set pressure can sometimes be detected. At that time, the engine rotational speed also becomes higher than the set rotational speed by the control of the engine controlling means. In the event of occurrence of such abnormality, the abnormality treating means will execute an engine stopping treatment for causing the engine to make an emergency stop.

Therefore, it has become possible not to allow abnormality such as excessive rising of the engine rotational speed to continue in a prolonged period when the abnormality developed in the intake passage.

Preferably, the abnormality treating means executes, after execution of the engine stopping treatment, a reporting treatment for reporting abnormality to a driver by activating a reporting means.

With the above-described arrangement, after the engine is caused to make an emergency stop due to occurrence of abnormality in the intake passage, this abnormality is reported to the driver by the reporting means. Then, the driver can recognize this abnormality and take any appropriate measure therefore.

In the present invention, preferably, the abnormality treating means stops the engine by stopping fuel supply to the engine.

With the above-described arrangement, fuel supply to the engine is stopped. So, the engine can be stopped in a reliable manner.

DETAILED DESCRIPTION OF PREFERRED EMBODIMENTS

Next, an embodiment of a work vehicle relating to the present invention will be described with reference to the accompanying drawings.

Incidentally, a front-rear direction in the following explanation of the embodiments is defined as follows, unless explicitly indicated otherwise. Namely, a direction denoted with an arrow F in FIG. 1 is defined as "front side", and a direction denoted with an arrow B in FIG. 1 is defined as "rear side", respectively.

[General Arrangement]

Figure 1:
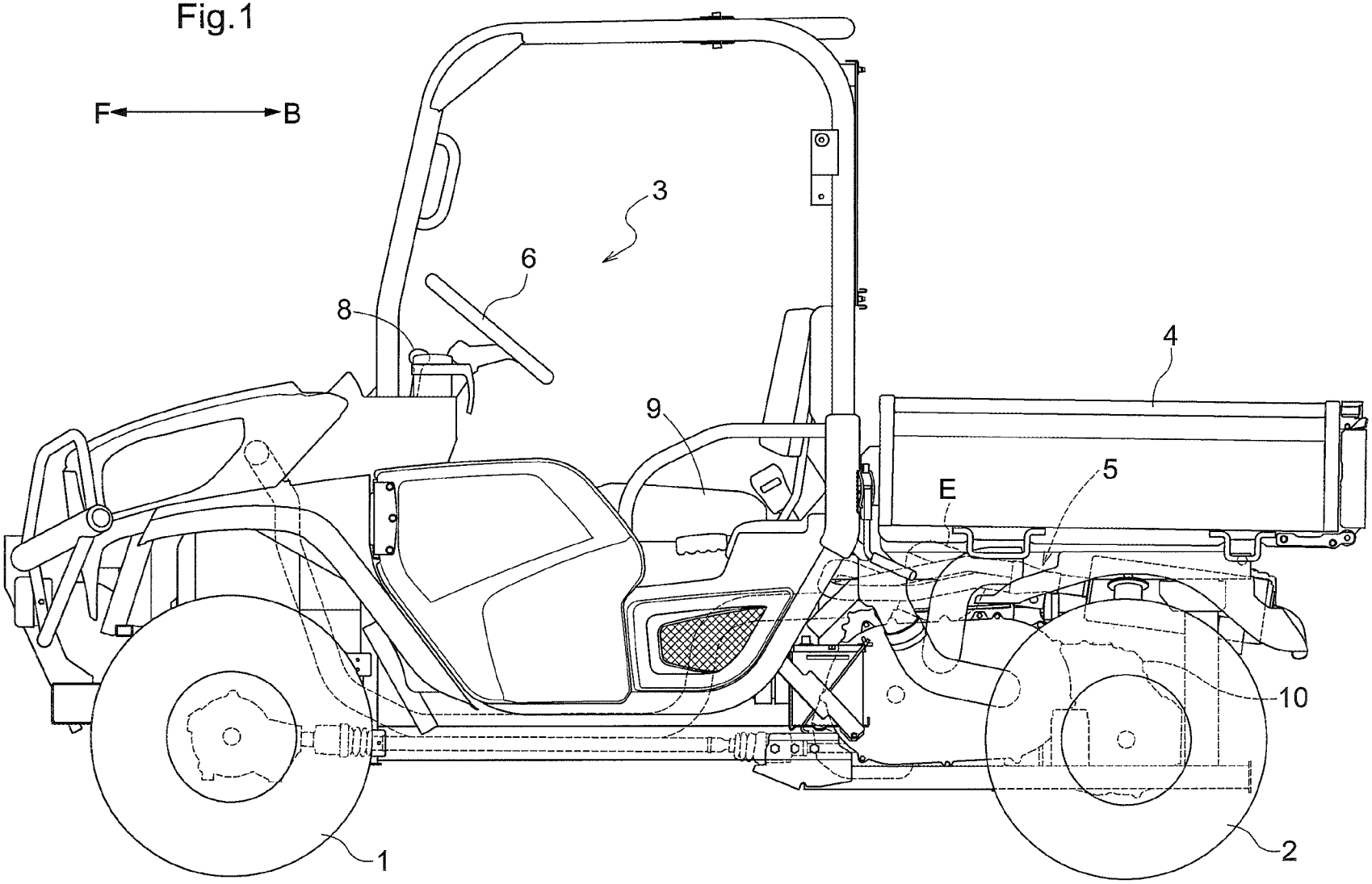
FIG. 1 is an overall side view.

FIG. 1 shows a multi-purpose work vehicle as one example of "work vehicle". Such multi-purpose work vehicle is configured as a vehicle that can be used for various purposes such as transport of load, a recreational activity, etc. This work vehicle includes a traveling vehicle body provided with a pair of left and right drivable and steerable front wheels 1 and a pair of left and right drivable rear wheels 2. At the center portion of the traveling vehicle body, there is provided a driving section 3 at which a driver will be seated and effect driving operations. At a rear portion of the traveling vehicle body, there is provided a load carrying deck 4 that can mount a load and can be operated for its dumping operation. Under the load carrying deck 4, an engine section 5 is provided.

At the driving section 3, there are provided a steering wheel 6 for steering the front wheels 1, an accelerator pedal 7 (see FIG. 3) as an "accelerator operational tool" capable of manual operation of changing a traveling speed, a speed changer lever 8 for speed changing operation, a driver's seat 9 at which a person can be seated, and so on. The accelerator pedal 7 is configured to be capable of a foot step-on operation and to be urgingly returned to its initial position upon release of a foot therefrom. The speed changer lever 8 is configured to be switchable by a pivotal operation, to a forward first-speed position, a forward second-speed position, a neutral position and a reverse position.

Figure 2:
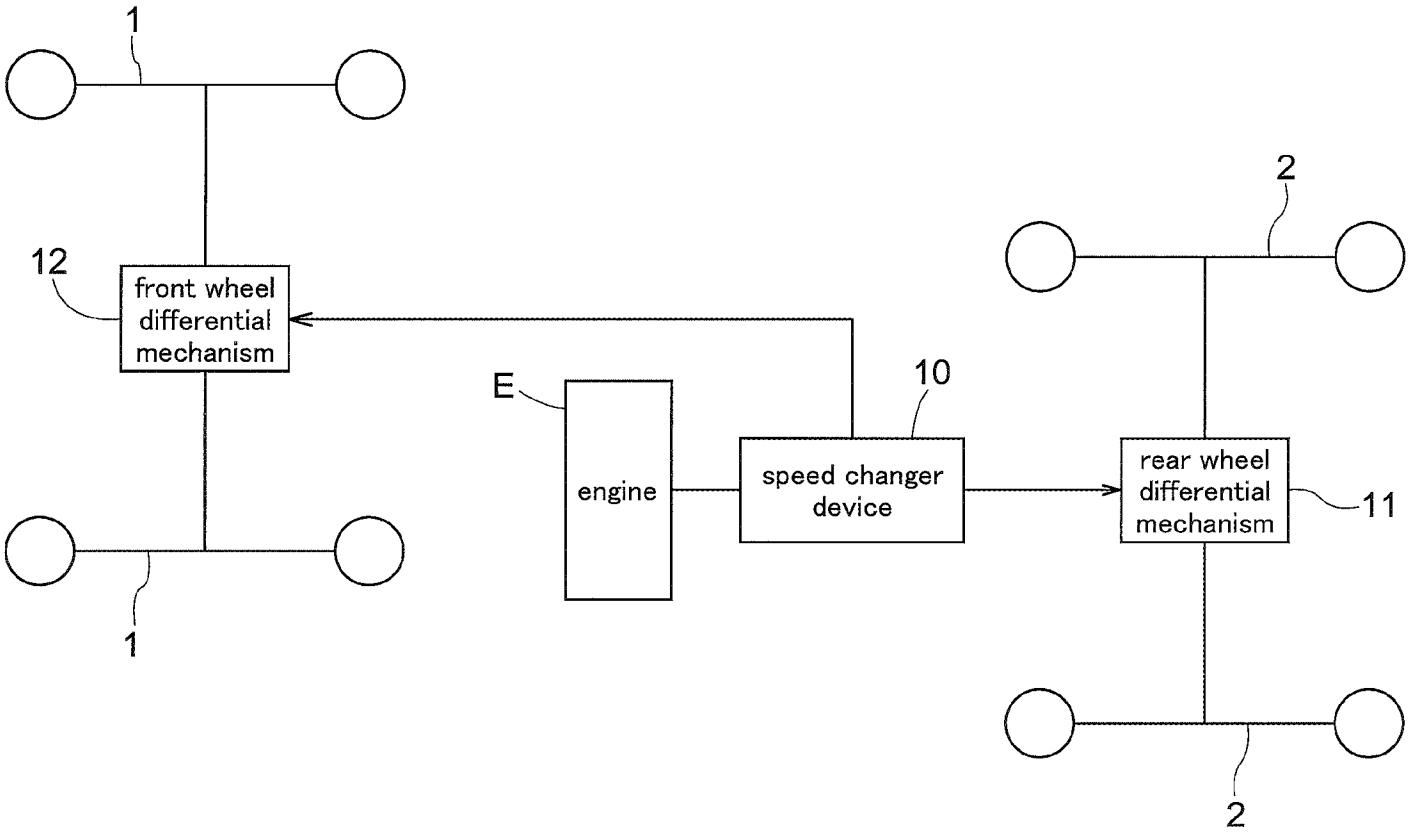
FIG. 2 is a transmission system diagram.

As shown in FIG. 2, the engine section 5 includes a gasoline engine (to be referred to shortly as "engine" hereinafter) E, and a speed changer device 10 for speed-changing output of the engine E and transmitting resultant speed-changed output to the front wheels 1 and the rear wheels 2. The speed changer device 10, though not specifically described herein, is capable of switching among a plurality of speed changed states having different speed changing ratios, by an operation on the speed changer lever 8. Specifically, the speed changing state of the speed changer device 10 can be switched among the forward first-speed state, the forward second-speed state, the neutral state and the reverse state. Under the neutral state, power transmission is disconnected, so the traveling vehicle body is set under a traveling stopped state. As shown in FIG. 2, power outputted from the speed changer device 10 is transmitted via a rear wheel differential mechanism 11 to the left and right rear wheels 2 and transmitted also to the left and right front wheels 1 via a front wheel differential mechanism 12.

[Control Arrangement for Abnormality in Intake System]

Figure 3:
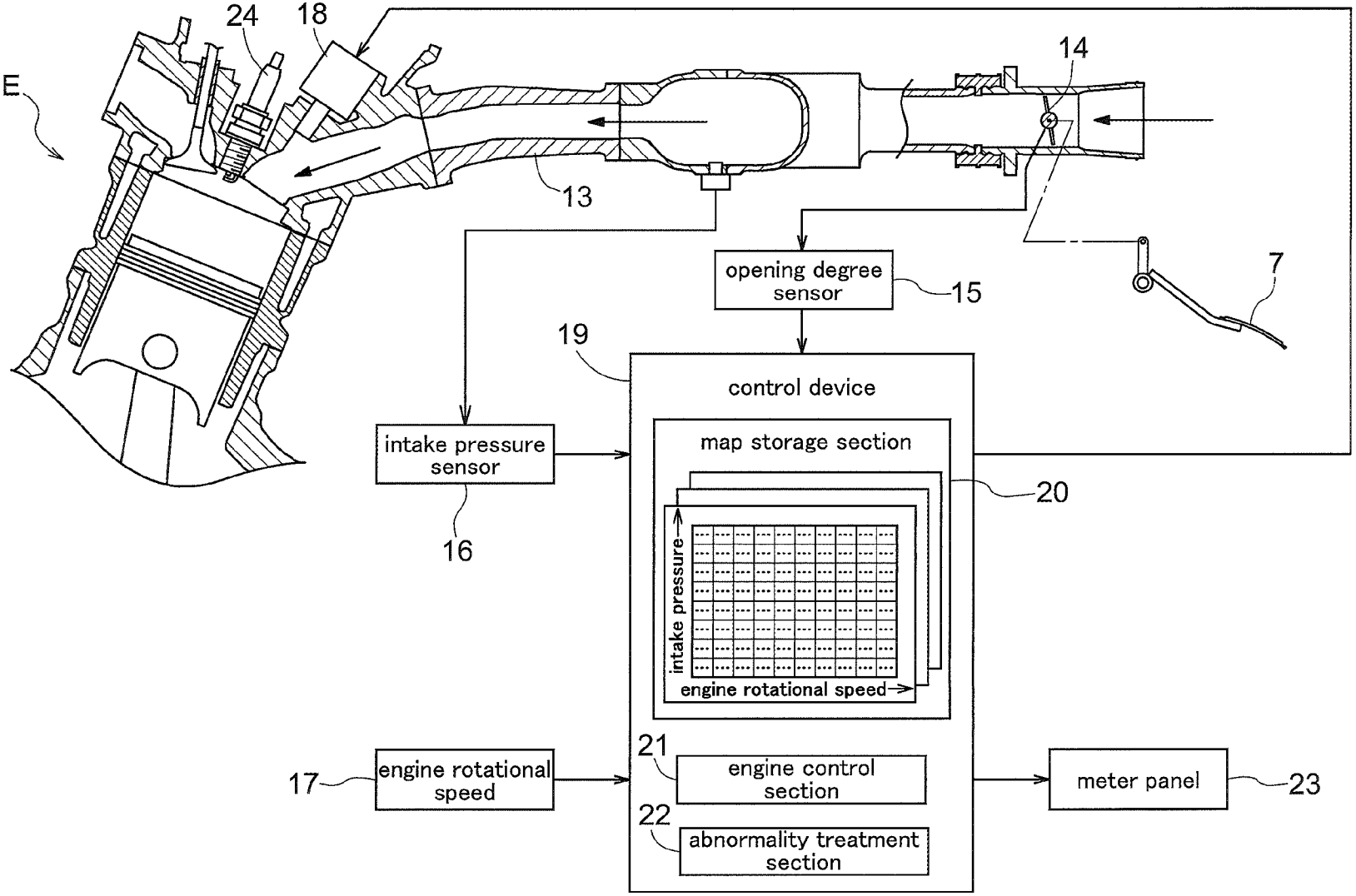
FIG. 3 is a control block diagram.

As shown in FIG. 3, a throttle valve 14 is provided for adjusting a supply amount of combustion air to a combustion air intake passage 13 for the engine E. The throttle valve 14 is operated in association with an operation of the accelerator pedal 7. Adjacent the throttle valve 14, there is provided an opening degree sensor 15 as an "opening degree detecting means" for detecting an opened state (actual opening degree) of the throttle valve 14.

An intake pressure sensor 16 is provided as an "intake pressure detecting means" for detecting an intake pressure on more downstream side than the throttle valve 14 in the intake passage 13. An engine rotation sensor 17 is provided as a "rotational speed detecting means" for detecting an actual rotational speed of the engine E.

At a portion of the intake passage 13 near the cylinders of the engine E, there is provided an injector 18 for feeding by injection fuel in the form of mist. A control device 19 is provided for controlling an output of the engine E by variably adjusting a fuel injection amount by the injector 18 for the engine E. The control device 19 is provided with a microcomputer. As shown in FIG. 3, the control device 19 includes a map storage section 20, an engine control section 21 as an "engine controlling means", and an abnormality treatment section 22 as an "abnormality treating means". The engine control section 21 and the abnormality treating section 22 are configured as control programs of the control device 19. Alternatively, however, the engine control section 21 and the abnormality treatment section 22 can be configured as an electronic circuit device having these sections distinctly. In the drawing, a numeral 24 denotes an ignition plug.

In the map storage section 20, there are recorded and stored in advance, in the form of map data, relationships between intake pressures corresponding to respective operational amounts of the accelerator pedal 7 and engine rotational speeds corresponding respectively to these intake pressures. Referring further briefly to the map data, in the map data, various control information is stored in the form of map with correlating the intake pressures and the engine rotational speeds. This map data can alternatively be configured such that air-fuel ratio data corresponding to a plurality of operational points on the map or ignition timing data corresponding to a plurality of operational points on the map are set in correlation with the map data in advance.

The engine control section 21 controls an operation of the injector 18, based on the map data, in such a manner that an actual air-fuel ratio of the engine E may arrive at a target air-fuel ratio corresponding to the intake pressure and the output rotational speed, thus adjusting a fuel injection amount for the engine E. More particularly, the engine control section 21 inputs detection information of the intake pressure sensor 16 and detection information of the engine rotation sensor 17 and sets a target air-fuel ratio corresponding to the detected value of the intake pressure sensor 16 and the detected value of the engine rotation sensor 17, from the map data. And, the engine control section 21 controls a fuel injection amount for the engine E by controlling the operation of the injector 18, so as to arrive at the target air-fuel ratio.

Figure 4:
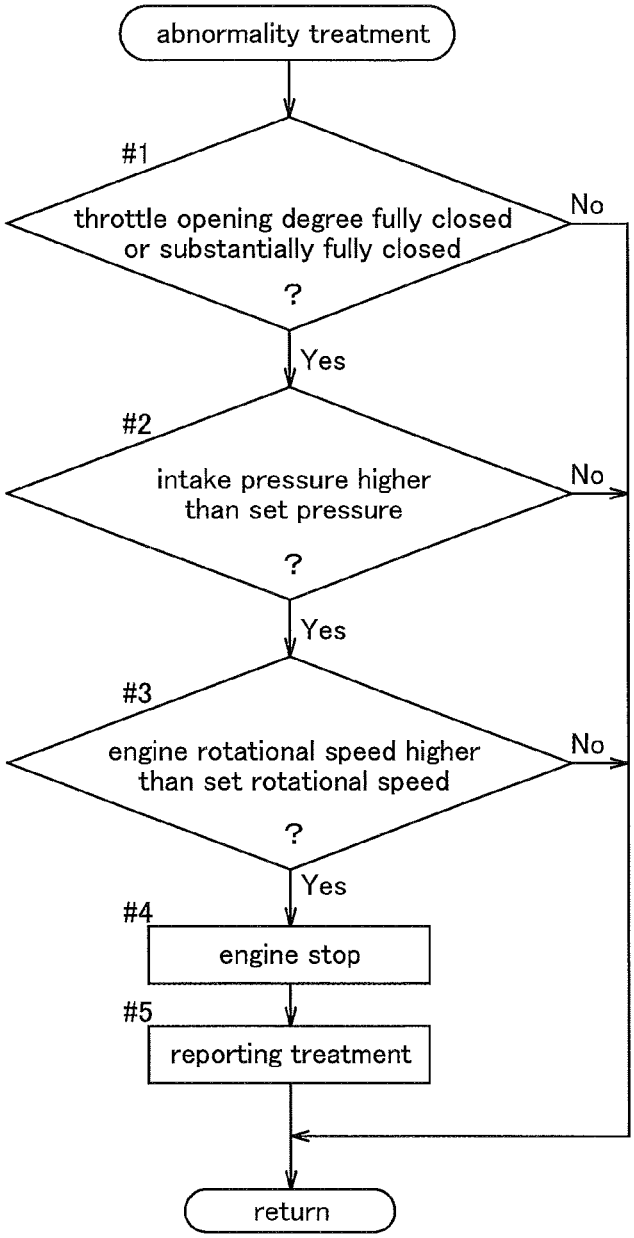
FIG. 4 is a flowchart of control operations.

As shown in FIG. 4, the abnormality treatment section 22 inputs detection information of the opening degree sensor 15, detection information of the intake pressure sensor 16 and detection information of the engine rotation sensor 17. And, if the intake pressure sensor 16 detects an intake pressure higher than a set pressure (step 2) and the engine rotation sensor 17 detects an engine rotational speed higher than a set rotational speed (step 3), when the throttle opening degree sensor 15 detects that the throttle valve 14 is under a fully closed or a substantially fully closed state, then, the abnormality treatment section 22 executes an engine stopping treatment for stopping operation of the engine E by stopping fuel supply to the engine E by the injector 18 (step 4).

As such set pressure for abnormality determination in the intake pressure, this is set as such an intake pressure as not leading to erroneous abnormality determination when the engine E is operating normally even if there occurs a change in the temperature of the engine E due to a certain operational condition or a change in the atmospheric pressure to an altitude difference.

The abnormality treatment section 22 acts as a reporting means simultaneously with the execution of the engine stopping treatment to effect a reporting operation for reporting the abnormality to the driver by causing an error code and an alarm lamp to be displayed on a meter panel 23 provided in the driving section 3 (step 5). Such reporting treatment can be any that can cause the driver to recognize the abnormality.

If the intake pressure and the engine rotational speed are high although the throttle valve 14 is under the fully closed or substantially fully closed state, then it may be assumed that a certain abnormality exists such as presence of damage in the midst of the intake passage 13, presence of a gap at a connecting portion of pipes, etc. Then, in such case, an emergency stop of the engine E is effected and also this is reported by the error code and the alarm lamp on the meter panel 23. With this, it is possible to avoid re-occurrence of abnormality such as excessive rise in the engine rotational speed by restart of the engine.

Other Embodiments (1) In the foregoing embodiment, as the reporting means, there are provided an error code and an alarm lamp to the meter panel 23. In place of this arrangement, reporting by means of an alarm buzzer or the like can be made. Or, the meter panel 23 and the alarm buzzer can be employed in combination as well.

(2) In the foregoing embodiment, the engine E is stopped by stopping fuel supply. Alternatively, the engine E can be stopped by stopping the operation of the ignition plug 24.

(3) In the foregoing embodiment, the accelerator pedal 7 is employed as the accelerator operational tool. Instead, a manual operation type accelerator lever may be employed.

(4) In the foregoing embodiment, a gasoline engine is employed as the engine E. Instead, a diesel engine may be employed.

(5) In the foregoing embodiment, the traveling vehicle body has the front wheels 1 and the rear wheels 2. Instead, a crawler type traveling device can be employed as the traveling device.

INDUSTRIAL APPLICABILITY

The present invention is applicable not only to a multipurpose work vehicle, but to various work vehicles such as a tractor, a combine, etc.

The invention claimed is:

1. A work vehicle comprising:

a throttle valve incorporated in an intake passage to an engine and operable in response to an operation on an accelerator operational tool;

an intake pressure sensor for detecting an intake pressure on more downstream side than the throttle valve in the intake passage;

an engine rotation sensor for detecting a rotational speed of the engine;

an engine control section program for controlling the engine based on a detection value of the intake pressure sensor and a detection value of the engine rotation sensor to arrive at a target air-fuel ratio corresponding to the detected intake pressure and the detected engine rotational speed;

an opening degree sensor for detecting an opening degree state of the throttle valve; and an abnormality treatment section program for executing an engine stopping treatment to stop the engine if the intake pressure sensor detects an intake pressure higher than a set pressure and the engine rotation sensor detects an engine rotational speed higher than a positive set rotational speed, when the opening degree sensor detects that the throttle valve is under a fully closed or substantially fully closed state.

2. The work vehicle of claim 1, wherein the abnormality treatment section program executes, after execution of the engine stopping treatment, a reporting treatment for reporting abnormality to a driver by activating a meter panel.

3. The work vehicle of claim 1, wherein the abnormality treatment section program stops the engine by stopping fuel supply to the engine.

4. The work vehicle of claim 1, wherein the intake pressure sensor detects the intake pressure higher than the set pressure independently of the engine rotation sensor detecting the engine rotational speed as higher than the positive set rotational speed.

* * * * *